US011845603B2

(12) United States Patent
Moretti

(10) Patent No.: US 11,845,603 B2
(45) Date of Patent: Dec. 19, 2023

(54) FLUID SUBSTANCE DISPENSING DEVICE

(71) Applicant: LUMSON S.p.A., Capergnanica (IT)

(72) Inventor: Matteo Moretti, Crema (IT)

(73) Assignee: LUMSON S.p.A., Capergnanica (IT)

( * ) Notice: Subject to any disclaimer, the term of this patent is extended or adjusted under 35 U.S.C. 154(b) by 0 days.

(21) Appl. No.: 17/534,652

(22) Filed: Nov. 24, 2021

(65) Prior Publication Data

US 2022/0161987 A1 May 26, 2022

(30) Foreign Application Priority Data

Nov. 25, 2020 (IT) ..... 102020000028313

(51) Int. Cl.

| | |
|---|---|
| ***B65D 83/00*** | (2006.01) |
| ***B05B 11/00*** | (2023.01) |
| ***B05B 11/04*** | (2006.01) |
| ***B05B 11/02*** | (2023.01) |
| ***B05B 11/10*** | (2023.01) |

(52) U.S. Cl.

CPC ..... *B65D 83/0055* (2013.01); *B05B 11/026* (2023.01); *B05B 11/048* (2013.01); *B05B 11/1047* (2023.01); *B05B 11/1059* (2023.01)

(58) Field of Classification Search

CPC .. B65D 83/0055; B65D 17/00; B65D 17/401; B65D 17/402; B65D 17/404; B65D 17/50; B05B 11/00412; B05B 11/048; B05B 11/3047; B05B 11/3059; B05B 11/0013; B05B 11/0037

See application file for complete search history.

(56) References Cited

U.S. PATENT DOCUMENTS

| | | | | |
|---|---|---|---|---|
| 3,797,705 A * | 3/1974 | Cooprider | B05B 11/3059 | 222/320 |
| 4,457,454 A * | 7/1984 | Meshberg | B05B 11/3066 | 222/207 |
| 4,457,455 A * | 7/1984 | Meshberg | B05B 11/3001 | 222/105 |
| 5,273,191 A * | 12/1993 | Meshberg | B05B 11/046 | 222/402.1 |
| 5,297,701 A * | 3/1994 | Steijns | B05B 11/3077 | 222/153.07 |
| 5,343,901 A * | 9/1994 | Meshberg | B05B 11/0037 | 141/2 |
| 6,435,376 B1 * | 8/2002 | Meshberg | B05B 11/3074 | 222/321.9 |
| 8,167,171 B2 * | 5/2012 | Moretti | B05B 11/1047 | 222/105 |
| 11,338,309 B2 * | 5/2022 | Alluigi | B05B 11/001 | |

(Continued)

FOREIGN PATENT DOCUMENTS

| | | | | |
|---|---|---|---|---|
| DE | 19653065 B4 * | 4/2008 | B65D 17/168 | |
| FR | 2813286 A1 | 3/2002 | | |
| WO | WO-9528327 A1 * | 10/1995 | B65D 11/02 | |

*Primary Examiner* — Donnell A Long

(74) *Attorney, Agent, or Firm* — Dickinson Wright PLLC; Andrew D. Dorisio

(57) ABSTRACT

A device for dispensing a fluid substance (F) comprising a manually operated pump (2) coupled to a deformable bag (3), the deformable bag being housed inside a container (4); the container (4) is formed of a collar (5) made of plastic material snap-coupled to a tubular element (6) formed from a paper or cardboard-based material.

16 Claims, 3 Drawing Sheets

(56) References Cited

U.S. PATENT DOCUMENTS

| | | | | |
|---|---|---|---|---|
| 2008/0257913 | A1* | 10/2008 | Contiero | B05B 11/001 222/383.1 |
| 2015/0210458 | A1* | 7/2015 | Ziegenfelder | B65D 41/005 53/476 |
| 2017/0266677 | A1* | 9/2017 | Alluigi | B05B 11/001 |
| 2020/0406279 | A1* | 12/2020 | Moretti | B05B 11/3001 |

* cited by examiner

FLUID SUBSTANCE DISPENSING DEVICE

This application claims priority to Italian Patent Application for Invention No. 102020000028313 filed on Nov. 25, 2020, the disclosure of which is incorporated herein by reference.

FIELD OF THE INVENTION

The present invention relates to a fluid substance dispensing device.

In particular, it relates to a device for dispensing a fluid substance housed inside a deformable bag coupled, in a sealed manner, to a manual dispensing pump, preferably of the hermetic variety.

BACKGROUND ART

Commonly known devices for dispensing fluid substances by means of a manual pump are made entirely of plastic. Therefore, the environmental impact thereof is significant.

Furthermore, costs for purchasing and moulding virgin or partially recycled plastic are high, and therefore commonly known devices are expensive. Especially when 'environmental taxes' are applied to the use of plastic.

SUMMARY OF THE INVENTION

The object of the present invention is to provide a device for dispensing a fluid substance which is more environmentally compatible than commonly known devices.

This and other objects are achieved by means of a device produced according to the technical teachings of the claims annexed hereto.

Advantageously, a device for dispensing a fluid substance according to the invention can be less expensive than commonly known devices.

BRIEF DESCRIPTION OF THE FIGURES

Further features and advantages of the innovation will become clearer in the description of a preferred but not exclusive embodiment of the device, illustrated—by way of a non-limiting example—in the drawings annexed hereto, in which.

DETAILED DESCRIPTION OF THE INVENTION

Figure 1:
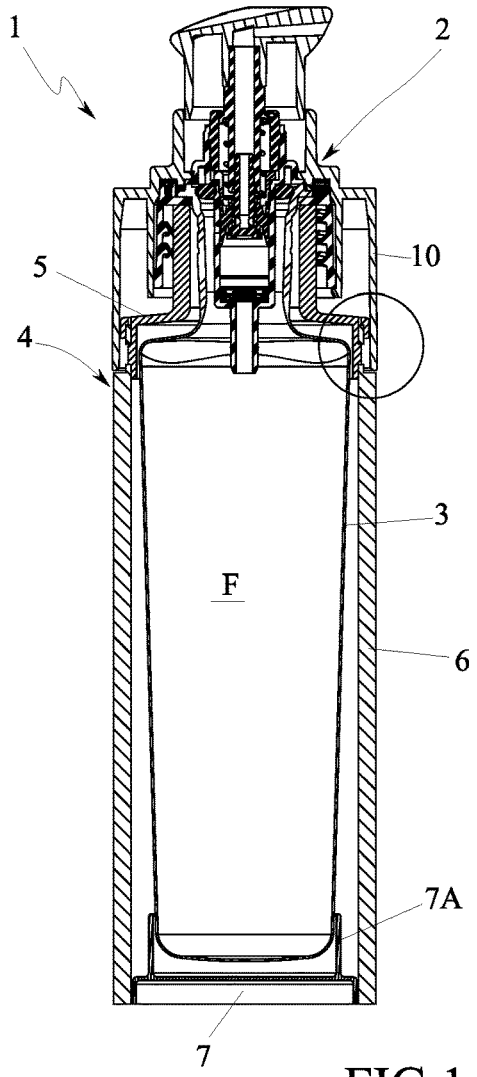
FIG. 1 is an axial section view of the present invention.
Figure 2:
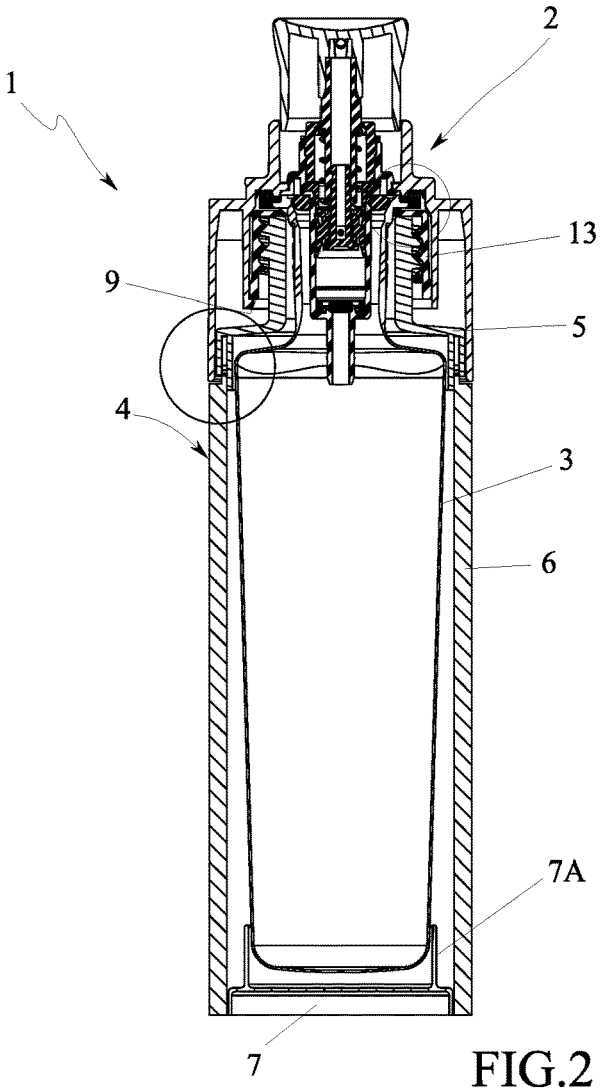
FIG. 2 is a further axial section view of the device in FIG. 1.
Figure 3:
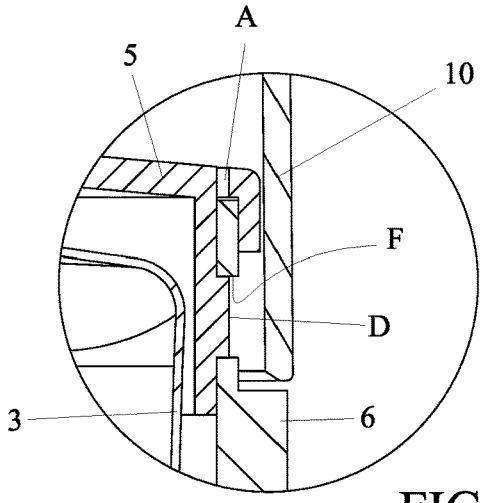
FIG. 3 is an enlarged view of the area enclosed within the circle in FIG. 1.
Figure 4:
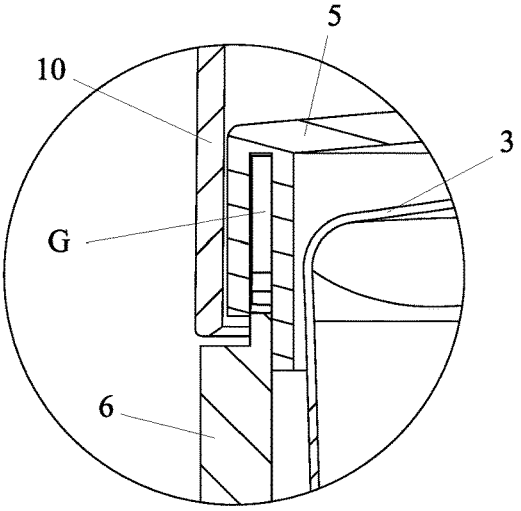
FIG. 4 is an enlarged view of the area enclosed within the circle at the bottom of FIG. 2.

With reference to the figures stated, reference number 1 is used to denote, as a whole, a fluid substance dispensing device.

In this wording, a 'fluid substance' means a liquid or cream product designed for cosmetic or medical purposes, such as a hand cream, foundation, body cream, face cream, serum, gel, anti-ageing cream, etc.

The device for dispensing a fluid substance F, housed inside a deformable bag 3, comprises a manually operated pump 2 which is preferably hermetic.

The pump may be of the type commonly known as 'airless', which prevents the entry of external air during the operation thereof. The said pump is coupled, in a sealed manner, to a deformable bag 3.

Therefore, when the fluid substance is dispensed by the pump, a vacuum is created inside the bag 3, which makes the bag deform as the fluid substance is dispensed.

The deformable bag 3 is housed inside a container 4.

The container 4 is formed of a collar 5 made of conventional plastic material coupled to a tubular element 6 formed from a paper or cardboard-based material.

The collar can be formed from a thermoplastic polymer material and can be injection-moulded. Materials suitable for making the collar comprise: PE, PE PCR, HDPE, HDPE PCR, PP, PP PCR, PA, cellulose-based plastic, wood fibre plastic, etc.

The paper-based (or rather cellulose-based) or paperboard-based (or cardboard-based) material can be made of virgin or recycled paper. Advantageously, it can be formed from a single sheet which as been rolled several times to lend it a certain rigidity.

The tubular element 6 can be made of multilayer cardboard and can have a thickness of between 1 mm and 4 mm. It can also be covered with an additional layer of coloured and/or decorated paper or paperboard glued on.

The tubular element 6 has a bottom 7.

The bottom 7 can be an element made as one piece together with the tubular element and as such is also made of paper-based material.

The bottom 7 can also be made as a separate piece from the tubular element, fastened thereto for example by glue or simply by interference-fit with the internal diameters of the tubular element, or the bottom 7 may have reflanging that encloses the edge of the tubular element.

In the event that the bottom is a separate element from the tubular element 6, the said bottom can be made of the same material as the tubular element, of a further cellulose—or cardboard-based material, or of conventional materials such as plastic or aluminium.

In the event that the bottom is made of a material which is different (in recyclability terms) from that of the tubular element 6, the said bottom can be configured to be uncoupled from the tubular element 6 when the device has to be recycled. Regarding this, the bottom 7 may feature a surface or a handgrip (not shown) to enable manual extraction or uncoupling from the tubular element.

Figure 10:
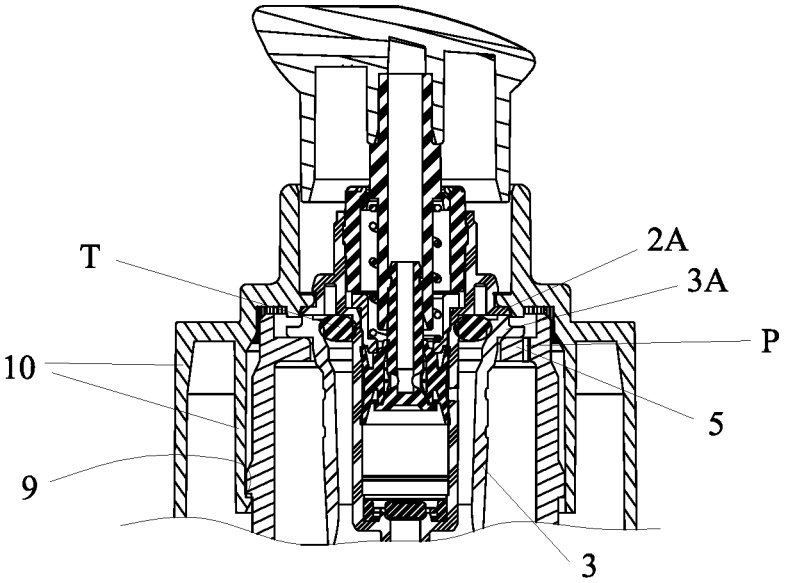
FIG. 10 is a simplified section view of the collar in FIG. 9 coupled to a tubular element and a pump.

As can be seen in FIG. 1 or 10, an annular wall 7A can extend from the bottom 7 towards the inside of the tubular element 6, into which wall a free end of the deformable bag 3 is inserted. The wall 7A can be configured to limit the movement of the bag inside the tubular element 6 when the bag is full.

According to the invention, the collar 5 is coupled, or rather snap-fitted onto, the tubular element 6.

For the snap-coupling, the tubular element can feature at least one window F which couples by means of at least one undercut D made in the collar.

Preferably, the tubular element features two mutually facing windows which engage with two (also mutually facing) teeth on the collar.

The at least one window can be made at one end of the tubular element 6 which has at least one notch I to facilitate elastic deformation of the end of the tubular element when the window engages with the undercut.

Advantageously, an external surface of the tooth D can be inclined (so as to converge towards the axis of the collar, being tapered downwards) so as to facilitate coupling with the tubular element 6.

Advantageously, above the tooth D, an opening may be featured which facilitates the moulding of the said tooth D.

The tubular element 6 can feature an area 6A which fits into an annular (optionally discontinuous) groove 8 made in the collar 5.

The area 6A can be made at the end of the tubular element which has the window(s) F.

Optionally, the area 6A can be thinner than the rest of the tubular element.

Furthermore, the tubular element can feature a easy-breakable area Z which, upon breaking, allows separation of the tubular element 6 from the collar 5 when the bag 3 is empty.

The easy-breakable area Z can be a knurl made of multiple breakable bridging elements, and can be made at the change in thickness between the area 6A and the tubular element.

The breakable area Z can also be obtained by a (not shown) reduced thickness zone (if compared to the thickness of the other parts of the tubular element close to the easy-breakable area Z).

Figure 5:
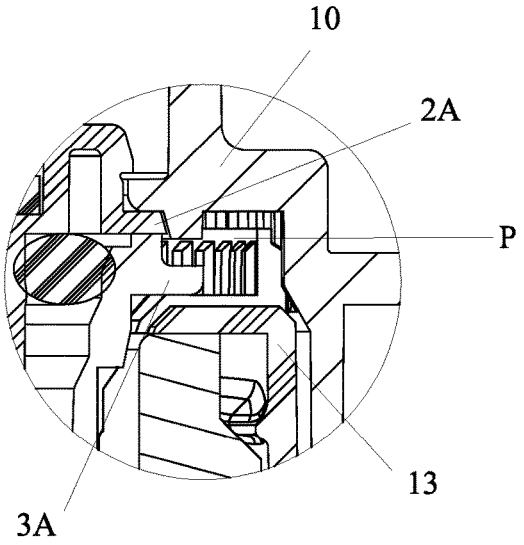
FIG. 5 is an enlarged view of the area enclosed within the circle at the top of FIG. 2.

A collar such as that shown in FIG. 5 can feature at least one undercut 9, for example with a tooth configuration, onto which an element 10 for locking the pump to the collar 5 is snap-coupled.

In this case, the pump 2 can feature (see FIG. 10) a first flange 2A and the deformable bag can feature a second flange 3A, both of which are placed in a mutual arrangement and sandwiched between the collar 5 and the locking element 10.

A sealing gasket T can be interposed between the pump 2 and the bag 3.

Figure 6:
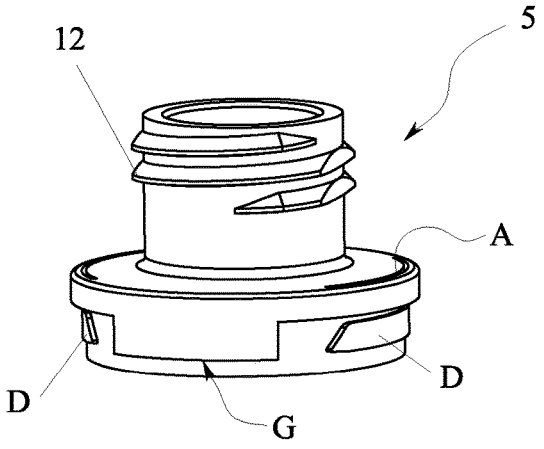
FIG. 6 is a perspective view of a collar of the device in FIG. 1.
Figure 7:
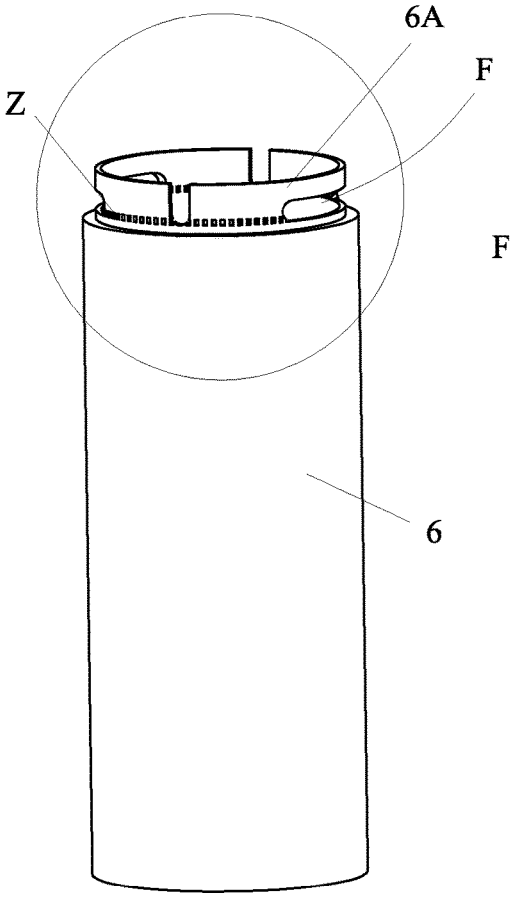
FIG. 7 is a perspective view of a tubular element of the device in FIG. 1.
Figure 8:
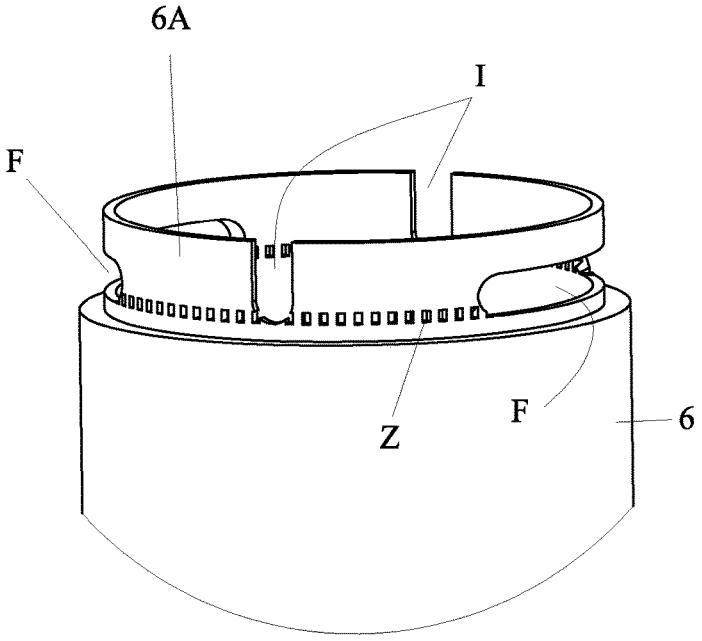
FIG. 8 is an enlarged view of the part circled in FIG. 7.
Figure 9:
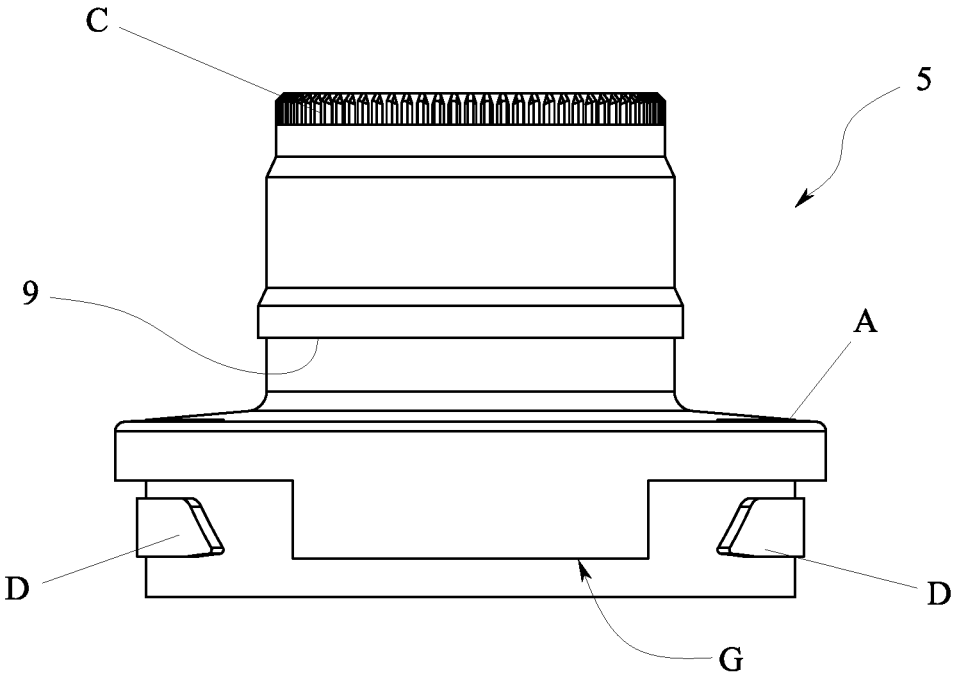
FIG. 9 is a side view of a possible configuration of the collar in FIG. 6.

As can be seen in FIG. 6, the collar 5 can feature a thread 12.

An intermediate element 13 can be screwed onto the thread 12, as shown in FIG. 1.

The pump fastening is clearly visible in FIG. 5. Essentially, a flange 13 of the deformable bag 3A can be placed on the element 3, and the intermediate element 13 can feature an undercut 9 (which in this case is on the free edge thereof) for snap-coupling the element 10 locking the pump 2, in a similar way to that described for FIG. 10.

To end the description, it should be noted that the collar 5 can feature an air passageway P in communication with the interior of the tubular element 2. Furthermore, the end of the collar 5 and/or of the intermediate element 13 may feature a cog C that allows the passage of air into the tubular element 2.

It is clear how the solution shown is environmentally compatible, as a cellulose-based material is used for the construction of a major, extensive part of the dispensing device.

For the same reasons, the device according to the invention may be produced more cheaply than a conventional plastic bottle, especially in places where an 'environmental tax' is applied to the use of plastic.

It should also be noted that by firmly rotating or pulling the collar and the tubular element, the two elements can be separated by breaking the breakable area Z (if featured), for more effective waste sorting.

It goes without saying that, from the same viewpoint, the presence of a bottom 7 which is also made of cardboard or a cellulose-based material is very advantageous.

Various embodiments of the innovation have been disclosed herein, but further embodiments may also be conceived using the same innovative concept.

The invention claimed is:

1. A dispensing device for a fluid substance (F), comprising a manually operated pump (2) coupled to a deformable bag (3), the deformable bag being housed inside a container (4), characterized in that the container is formed by a collar (5) made of plastic material snap coupled to a tubular element (6) formed in a material based on paper or cardboard, the tubular element has at least one window (F) which is coupled in at least one undercut (D) made in the collar;

wherein the collar (5) provides at least one undercut (9) to which a locking element (10) of the pump (2) is snapped onto the collar (5), and in which the pump (2) has a first flange (2A) and the deformable bag has a second flange (3A) which are mutually placed and sandwiched between the collar (5) and the locking element (10).

2. The device according to claim 1, wherein the at least one window is made at one end of the tubular element (6) which carries at least one notch (I) to facilitate the elastic deformation of the end of the tubular element when the window snaps to the undercut.

3. The device according to claim 1, in which the tubular element (6) has an area (6A) which is inserted in an annular groove (8) obtained in the collar (5).

4. The device according to claim 3 in which the area (6A) has a reduced thickness compared to the rest of the tubular element.

5. The device according to claim 1, in which the tubular element has an easy-breakable area (Z) which, once broken, allows to separate the tubular element (6) from the collar (5) when the bag (3) is empty.

6. The device according to claim 5, wherein the easy-breakable area (Z) comprises a knurl or the easy-breakable area (Z) features a reduced thickness zone, if compared to the thickness of the other parts of the tubular element close to the easy-breakable area.

7. The device according to claim 6, wherein the easy-breakable area (Z) is made at a change of thickness between the area (6A) and the tubular element.

8. The device according to claim 1, wherein from a bottom (7) of the tubular element (6) an annular wall (7A) extends towards the inside of the tubular element (6) into which a free end of the deformable bag (3) is inserted so as to limit the movement of the bag inside the tubular element (6) when the bag is full or in which the bottom (7) is made in a different piece from the tubular element (6) or in which the bottom (7) provides a grip to release it from the tubular element for disposal.

9. The device according to claim 8, wherein the bottom (7) is made of a paper-based material or cardboard.

10. The device according to claim 1, wherein the collar (5) has a thread (12) on which an intermediate element (13) is screwed to which a flange (3A) of the deformable bag (3) is placed, the intermediate element (13) having an undercut (9) for the snap coupling of the locking element (10) of the pump (2).

11. The device according to claim 10, in which the collar (5) provides an air passage (P) in communication with the interior of the tubular element (2) or in which one end of the collar (5) or one end of the intermediate element (13), have a toothed crown (C) which allows the passage of air inside the tubular element (2).

12. The device according to claim 1, wherein the at least one undercut comprises two undercuts, each of the two undercuts including an external surface that is inclined to be tapered along an axis defined by the collar.

13. A dispensing device for a fluid substance (F), comprising a manually operated pump (2) coupled to a deformable bag (3), the deformable bag being housed inside a container (4), characterized in that the container is formed by a collar (5) made of plastic material snap coupled to a tubular element (6) formed in a material based on paper or cardboard, the collar (5) provides at least one undercut (9) to which a locking element (10) of the pump is snapped onto the collar (5), and in which the pump (2) has a first flange (2A) and the deformable bag has a second flange (3A) which are mutually placed and sandwiched between the collar (5) and the locking element (10).

14. A dispensing device for a fluid substance (F), comprising a manually operated pump (2) coupled to a deformable bag (3), the deformable bag being housed inside a container (4), characterized in that the container is formed by a collar (5) made of plastic material snap coupled to a tubular element (6) formed in a material based on paper or cardboard, the collar (5) has a thread (12) on which an intermediate element (13) is screwed to which a flange (3A) of the deformable bag (3) is placed, the intermediate element (13) having an undercut (9) for the snap coupling of the locking element (10) of the pump (2).

15. The device according to claim 14, in which the collar (5) provides an air passage (P) in communication with the interior of the tubular element (2) or in which one end of the collar (5) or one end of the intermediate element (13), have a toothed crown (C) which allows the passage of air inside the tubular element (2).

16. A dispensing device for a fluid substance (F), comprising a manually operated pump (2) coupled to a deformable bag (3), the deformable bag being housed inside a container (4), characterized in that the container is formed by a collar (5) made of plastic material snap coupled to a tubular element (6) formed in a material based on paper or cardboard, the tubular element has at least one window (F) which is coupled in at least one undercut (D) made in the collar, wherein the collar (5) has a thread (12) on which an intermediate element (13) is screwed to which a flange (3A) of the deformable bag (3) is placed, the intermediate element (13) having an undercut (9) for the snap coupling of the locking element (10) of the pump (2).

* * * * *